United States Patent [19]

Mattila

[11] Patent Number: 4,700,407

[45] Date of Patent: Oct. 20, 1987

[54] PROTECTIVE GARMENT

[75] Inventor: Heikki Mattila, Puolanka, Finland

[73] Assignee: Sinisalo Sport OY, Puolanka, Finland

[21] Appl. No.: 897,020

[22] Filed: Aug. 15, 1986

[30] Foreign Application Priority Data

Jun. 26, 1986 [FI] Finland ..... 862735

[51] Int. Cl.[4] ..... A41D 13/00; A41D 27/26

[52] U.S. Cl. ..... 2/23; 2/267; 2/16; 2/2

[58] Field of Search ..... 2/23, 22, 24, 20, 16, 2/2, 267

[56] References Cited

U.S. PATENT DOCUMENTS

| | | | |
|---|---|---|---|
| 759,765 | 5/1904 | Stall | 2/23 |
| 759,833 | 5/1904 | Stall | 2/23 |
| 2,688,748 | 9/1954 | Kahn | 2/267 X |
| 2,696,005 | 12/1954 | Schaumer | 2/267 X |
| 2,719,301 | 10/1955 | Witkower | 2/267 X |
| 4,193,134 | 3/1980 | Hanrahan et al. | 2/16 |
| 4,325,148 | 4/1982 | Livernois | 2/2 |
| 4,479,269 | 10/1984 | Balliet | 2/23 |

*Primary Examiner*—Werner H. Schroeder
*Assistant Examiner*—J. L. Olds
*Attorney, Agent, or Firm*—Cushman, Darby & Cushman

[57] ABSTRACT

The invention relates to a protective garment, especially a sports garment, which includes a layer made of a wear-resistant, resilient basic material (1) for protecting the person who wears the garment. In order to provide an efficient protective effect, the garment is provided with resilient, shock-absorbing pads (3, 4). The pads (3, 4) are fitted in openings formed in the basic material (1) and fastened stationarily to the basic material (1) in such a manner that part of the layer protecting the person wearing the garment is formed solely by the pads (3,4).

4 Claims, 3 Drawing Figures

PROTECTIVE GARMENT

BACKGROUND OF THE INVENTION

1. Field of the Invention

The invention relates to a protective garment, especially a sports garment, comprising a layer of a wear-resistant, resilient material for protecting the person who wears the garment.

2. Description of the Related Art

This type of protective garment is nowadays particularly known in connection with different sports. Sports such as motor racing and motorcross in particular, are examples of sports in which these kinds of garments, e.g. trousers, shirts, and overalls, are used.

The problem with motor racing and motorcross in particular, has been the provision of shock-absorbing pads at different points of the body of the racer. The thighs and the hip of the racer, for instance, should be protected against shocks.

Prior sports garments, e.g. hip guards and kidney belts, are used for protecting the body at desired points. An example of known solutions would be trousers, the back part of which is provided with a detachable pad fastened on the inside thereof by means of stickers.

A disadvantage of such detachable pads is that they are inconvenient in use. Additionally, it is possible that, if the pad comes off and is displaced away from its proper place, e.g. during a long race, the protective effect is decreased. Also, a detached pad which is at a wrong place or in a wrong position may decisively hamper the wearer's driving.

SUMMARY OF THE INVENTION

The object of the invention is to provide a protective garment which avoids the disadvantages of the prior art. This object is achieved by means of a protective garment according to the invention which is characterized in that the garment is provided with resilient, shock-absorbing pads which are fitted in openings formed in the basic material and fastened stationarily flush with the basic material in such a manner that part of the layer protecting the person wearing the garment is formed solely by the pads.

The solution according to the invention is advantageous mainly in that it is versatile: shock-absorbing pads can be advantageously positioned at desired points of the body to obtain the best possible protective effect. A further advantage is that the pads are absolutely reliably maintained in the right position and at the right place even during a long race or driving distance. Additionally, the protective garment according to the invention is comfortable in use, and ensures that the driver does not forget the pads when he starts off. The protective garment according to the invention is also advantageous in the manufacturing costs thereof.

BRIEF DESCRIPTION OF THE DRAWINGS

The invention will be described more closely below by means of one preferred embodiment thereof, which embodiment is illustrated in the attached drawings.

DETAILED DESCRIPTION OF THE PREFERRED EMBODIMENT

The figures illustrate the principle features of a protective garment according to the invention. The embodiment of the figures illustrates especially trousers intended for use in motorcross.

The trousers shown in the figures are manufactured of a wear-resistant, resilient basic material 1 suited for the purpose, e.g. polyester-polyamide, polyamide/nylon or cotton/polyamide or combinations thereof. The front and back parts of the garment can be wholly manufactured of one and the same material or of different materials according to the wishes of the person who wears the garment.

The trousers shown in the figures are also provided with leather reinforcements 2 which improve the wearing strength. These leather reinforcements 2 are not, of course, necessary but should be seen as an example of the different embodiments.

The above matters as well as the manufacturing steps of the trousers are completely obvious to one skilled in the art, wherefore these items are not discussed in more detail here.

Figure 1:
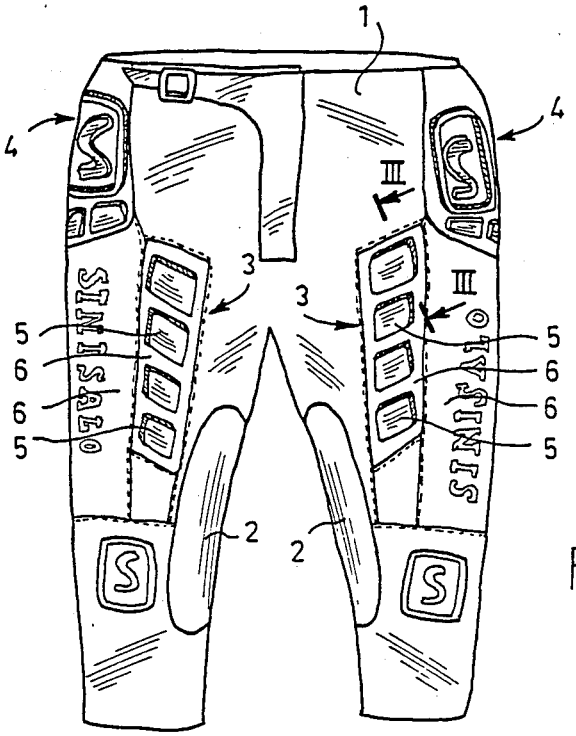
FIG. 1 is a general front view of a garment according to the invention.
Figure 3:
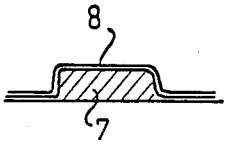
FIG. 3 is a section along the line shown by the arrows III—III in FIG. 1.
Figure 2:
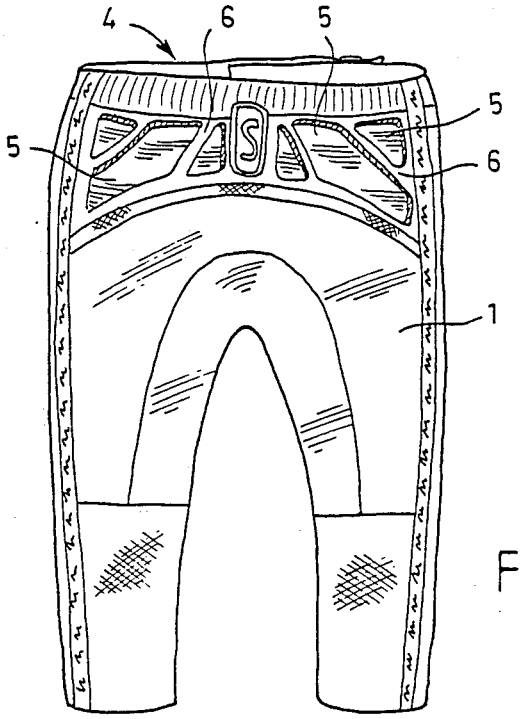
FIG. 2 is a back view of the garment of FIG. 1.

According to the invention the garment is provided with resilient, shock-absorbing pads 3, 4. These pads 3, 4 are fitted in openings provided in the basic material 1 and fastened stationarily flush as clearly shown in FIG. 3, with the edges of the openings in such a manner that part of the layer which protects the user is formed solely by the pads 3, 4. The size and shape of the pads 3,4 substantially corresponds to the size and shape of the openings of the basic material 1, as also shown in FIG. 3.

The pads 3, 4 can be manufactured of any suitable material. The use of a soft plastic material, such as e.g. cellular plastic, has proved to be particularly advantageous.

When the pads 3, 4 are manufactured of a plastic material 7, it is advantageous that a surface layer 8 of a resilient material is laminated on the surface of the plastic material 7. This surface layer 8 makes the pad more durable and more attractive in appearance. It can be formed of a textile fabric, e.g. a lycra type material. This kind of solution is illustrated in FIG. 3.

The pads 3, 4 can be advantageously manufactured in the following way. A resilient surface layer 8 is laminated on the surface of a sheet of cellular plastic 7. Thereafter a pad 3,4 is formed by means of a mould. The active surface of the mould has the form of the mirror image of the pad 3,4 so that elevations 5 and thinner areas 6 can be formed by pressing said active surface of the mould against the laminated surface 8 of the sheet of cellular plastic 7. By virtue of the resilience of the surface layer 8, the finished pad 3,4 is steady and neat. Different kinds of pads can be formed of one and the same plastic sheet by the use of different kinds of moulds. The shape and the resilience of the pads 3,4 can be altered as required. The pads 3,4 can also be provided with various patterns, trademarks of the manufacturer, etc.

The pads 3, 4, which are manufactured as described above, are fastened at the designed points in the openings of the basic material in any suitable manner, e.g. by sewing. By virtue of this arrangement, less basic material 1 is needed and, further, the resilience of the padded point or area is the best possible, because this point or area is not too thick.

The embodiment described above is not intended to restrict the invention, but the invention can be modified within the scope of the claims in various ways. Consequently, it is obvious that the protective garment according to the invention can also be e.g. a shirt or overalls. Further, it is to be understood that the position or the shape of the pads 3, 4 is not restricted to the example of the figures. So the pads of the trousers can be positioned on the outer side of thighs, and the pads 3,4 of the back part of the trousers, i.e. the waist part, can reach further up, etc. It is also obvious that the protective garment can be provided with any desired lining, or the lining can be left out. The belt solution can be any suitable solution. Various pockets, resilient parts and other details connected e.g. with the appearance can, naturally, be modified completely freely. The protective garment according to the invention is not, either, restricted to sports use, but the invention can be applied to working clothes, free-time clothes, children's clothes etc. The surface layer 8 can, of course, be formed on both sides of the plastic sheet 7, if this change is considered necessary. The choice of the material of the surface layer 8 is not restricted, but any suitably resilient material can be used.

I claim:

1. A protective garment, especially a sports garment, comprising a layer formed of a wear-resistant, resilient basic material protecting the person who wears the garment, said garment being provided with resilient, shock-absorbing pads which are fitted in openings formed in the basic material and fastened stationarily flush with the basic material in such a manner that part of the layer protecting the person wearing the garment is formed solely by the pads.

2. A protective garment according to claim 1, wherein the pads are made of a soft plastic material.

3. A protective garment according to claim 2, wherein a surface layer of a resilient material is laminated on the surface of the plastic material.

4. A protective garment according to claim 3, wherein the surface layer is made of a textile fabric.

* * * * *